US009244398B2

(12) United States Patent
Miyazaki

(10) Patent No.: US 9,244,398 B2
(45) Date of Patent: Jan. 26, 2016

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yasunari Miyazaki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/285,716

(22) Filed: May 23, 2014

(65) Prior Publication Data

US 2015/0338798 A1 Nov. 26, 2015

(51) Int. Cl.
*G03G 15/20* (2006.01)

(52) U.S. Cl.
CPC ..... *G03G 15/2039* (2013.01)

(58) Field of Classification Search
CPC ..... G03G 15/205; G03G 15/2039; G03G 2215/2025
USPC ..... 399/69
See application file for complete search history.

(56) References Cited

U.S. PATENT DOCUMENTS

2002/0061200 A1* 5/2002 Sakakibara et al. ..... 399/69
2007/0274748 A1* 11/2007 Yoshikawa ..... 399/329
2009/0196644 A1* 8/2009 Funatsu ..... 399/69
2009/0257770 A1 10/2009 Miyazaki

* cited by examiner

*Primary Examiner* — David Gray
*Assistant Examiner* — Thomas Giampaolo, II
(74) *Attorney, Agent, or Firm* — Amin, Turocy & Watson, LLP

(57) ABSTRACT

In accordance with one embodiment, an image forming apparatus comprises a heating member configured to heat a recording medium, on the surface of which a toner image is carried, to fix the toner on the recording medium; a pressing member configured to contact with the recording paper from the back side of the recording paper; an induction heating section configured to heat the heating member through induction heating; a temperature sensor configured to detect the temperature nearby the heating member; a driving control section configured to carry out a control based on the temperature detected by the temperature sensor so that the temperature of the heating member based on the induction heating section is within an allowable temperature range; a temperature range setting section configured to set the allowable temperature range so that the allowable temperature range is narrowed as time elapses from the start of a fixing processing.

10 Claims, 13 Drawing Sheets

| | MACHINE TEMPERATURE (Te) | | | |
|---|---|---|---|---|
| PAPER-PASSING TIME (MINUTE) | LOW TEMPERATURE (Te≦16℃) | ORDINARY TEMPERATURE (16℃<Te<30℃) | HIGH TEMPERATURE (Te≧30℃) | NUMBER OF PASSING PAPER (SHEET) |
| 0~1 | $i=2(T_2=10℃)$ | $i=2(T_2=10℃)$ | $i=2(T_2=10℃)$ | 0~50 |
| 1~2 | $i=2(T_2=10℃)$ | $i=2(T_2=10℃)$ | $i=1(T_1=5℃)$ | 50~100 |
| 2~3 | $i=2(T_2=10℃)$ | $i=1(T_1=5℃)$ | $i=1(T_1=5℃)$ | 100~150 |
| 3~4 | $i=2(T_2=10℃)$ | $i=1(T_1=5℃)$ | $i=0(T_0=0℃)$ | 150~200 |
| 4~5 | $i=1(T_1=5℃)$ | $i=1(T_1=5℃)$ | $i=0(T_0=0℃)$ | 200~250 |
| 5~6 | $i=1(T_1=5℃)$ | $i=0(T_0=0℃)$ | $i=-1(T_{-1}=-5℃)$ | 250~300 |
| 6~ | $i=1(T_1=5℃)$ | $i=0(T_0=0℃)$ | $i=-1(T_{-1}=-5℃)$ | 300~ |

FIG.9

| PAPER CATEGORY | PAPER BASIS WEIGHT | CORRECTION CONDITION |
|---|---|---|
| PLAIN PAPER | ~79g/$m^2$ | CORRECTION CONDITION 1 SHOWN IN FIG. 13 |
| | 80g/$m^2$~105g/$m^2$ | AS SHOWN IN FIG. 9 |
| RECYCLED PAPER | – | CORRECTION CONDITION 1 SHOWN IN FIG. 13 |
| THICK PAPER 1 | 106g/$m^2$~156g/$m^2$ | CORRECTION CONDITION 2 SHOWN IN FIG. 14 |
| THICK PAPER 2 | 157g/$m^2$~209g/$m^2$ | AS SHOWN IN FIG. 9 |
| THICK PAPER 3 | 210g/$m^2$~256g/$m^2$ | AS SHOWN IN FIG. 9 |
| THICK PAPER 4 | 257g/$m^2$~300g/$m^2$ | AS SHOWN IN FIG. 9 |

FIG.12

FIG.13

| PAPER-PASSING TIME/MINUTE | MACHINE TEMPERATURE Te<br>ORDINARY TEMPERATURE (16℃<Te<30℃) | NUMBER OF PASSING PAPER/SHEET |
|---|---|---|
| 0~1 | i=2 ($T_2$=10℃) | 0~50 |
| 1~2 | i=1 ($T_1$=5℃) | 50~100 |
| 2~3 | i=1 ($T_1$=5℃) | 100~150 |
| 3~4 | i=0 ($T_0$=0℃) | 150~200 |
| 4~5 | i=0 ($T_0$=0℃) | 200~250 |
| 5~6 | i=-1 ($T_{-1}$=-5℃) | 250~300 |
| 6~ | i=-1 ($T_{-1}$=-5℃) | 300~ |

FIG.14

| PAPER-PASSING TIME/MINUTE | MACHINE TEMPERATURE Te<br>ORDINARY TEMPERATURE (16℃<Te<30℃) | NUMBER OF PASSING PAPER/SHEET |
|---|---|---|
| 0~1 | i=2 ($T_2$=10℃) | 0~50 |
| 1~2 | i=2 ($T_2$=10℃) | 50~100 |
| 2~3 | i=2 ($T_2$=10℃) | 100~150 |
| 3~4 | i=1 ($T_1$=5℃) | 150~200 |
| 4~5 | i=1 ($T_1$=5℃) | 200~250 |
| 5~6 | i=0 ($T_0$=0℃) | 250~300 |
| 6~ | i=0 ($T_0$=0℃) | 300~ |

IMAGE FORMING APPARATUS

FIELD

Embodiments described herein relate to an image forming apparatus.

BACKGROUND

An image forming apparatus generally forms a latent image on a photoconductive drum, develops and visualizes the latent image with toner, and then transfers the visualized toner image to a recording paper and fixes the visualized toner image on the recording paper by heating. Heating is needed on the fixing process, and a fixing device which heats and fixes an image through induction heating is known.

The heating temperature control in the fixing device is important, and in the induction heating, generally, the power supplied for an IH coil is controlled to control the heating temperature. However, if the temperature is set to a given value, the frequency of changing power is increased and the temperature ripple is increased. When the temperature is low, an image defect is caused and a stable fixing processing cannot be carried out due to the low temperature offset and the like. Thus, it is necessary to maintain the heating temperature in a constant width and reduce the temperature ripple.

However, in most cases, the fixing condition changes due to the temperature in the image forming apparatus even if the heating temperature is maintained in a constant width, which leads to an unstable fixation.

Thus, the purpose of the present invention is to provide an image forming apparatus capable of carrying out a stable fixing processing constantly.

DESCRIPTION OF THE DRAWINGS

FIG. 9 is a diagram illustrating an example of the constitution of a power control section according to the first embodiment;

FIG. 12 is a diagram illustrating an example of changing an allowable temperature range according to a paper category;

FIG. 13 is a diagram illustrating an example of conditions of changing the allowable temperature range; and FIG. 14 is a diagram illustrating another example of conditions of changing the allowable temperature range.

DETAILED DESCRIPTION

In accordance with one embodiment, an image forming apparatus comprises a heating member configured to heat a recording medium, on the surface of which a toner image is carried, to fix the toner on the recording medium; a pressing member configured to contact with the recording paper from the back side of the recording paper; an induction heating section configured to heat the heating member through induction heating; a temperature sensor configured to detect the temperature nearby the heating member; a driving control section configured to carry out a control based on the temperature detected by the temperature sensor so that the temperature of the heating member based on the induction heating section is within an allowable temperature range; a temperature range setting section configured to set the allowable temperature range so that the allowable temperature range is narrowed as time elapses from the start of a fixing processing.

The embodiments of the present invention are described below with reference to the accompanying drawings.

A First Embodiment

Figure 1:
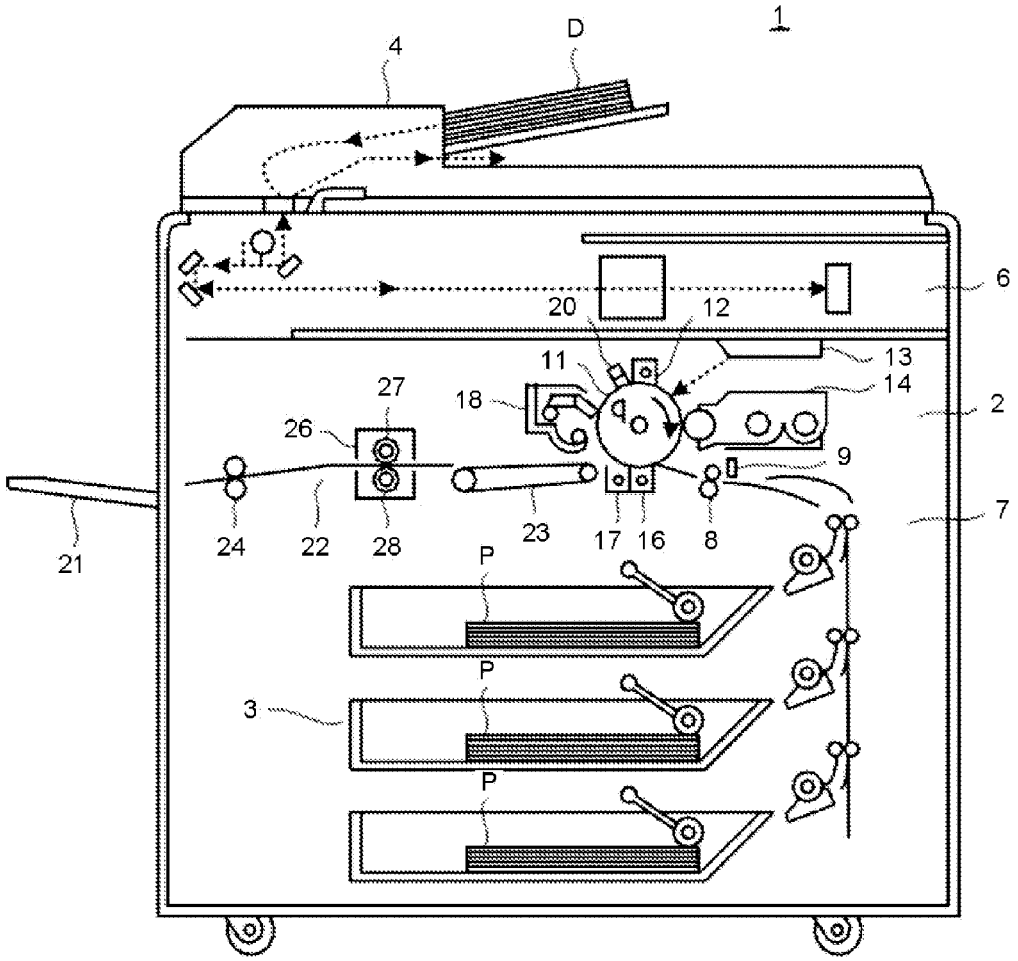
FIG. 1 is a diagram illustrating the structure of an image forming apparatus according to a first embodiment.

FIG. 1 is a schematic diagram illustrating the whole constitution of a copier serving as one example of the image forming apparatus according to the first embodiment.

An image forming apparatus 1 comprises a cassette mechanism 3 for feeding paper P serving as a recording medium to an image forming section 2, and comprises, at the upper portion, a scanning device 6 for reading a document D fed by an automatic document feeder 4. A register roller 8 is arranged on a conveyance path 7 from the cassette mechanism 3 to the image forming section 2.

The image forming section 2 is provided with, in sequence in a rotation direction of the photoconductive drum 11 indicated by an arrow q, a charging device 12 which uniformly charges a photoconductive drum 11, a laser exposure device 13 which forms a latent image on the charged photoconductive drum 11 based on the image data from the scanning device 6, a developing device 14, a transferring charger 16, a peeling charger 17, a cleaner 18 and a charge removing LED 20 around the photoconductive drum 11. The image forming section 2 forms a toner image on the photoconductive drum 11 through an image forming process based on a well-known electro photographic system and then transfers the toner image to the paper P.

At the downstream side of the conveyance direction of the paper P in the image forming section 2, a paper discharge conveyance path 22 is arranged to convey the paper P transferred with the toner image towards the direction of a paper discharge section 21. On the paper discharge conveyance path 22, a conveyance belt 23 for conveying the paper P peeled from the photoconductive drum 11 to a fixing device 26 and a paper discharge roller 24 for discharging the paper P passing through the fixing device 26 to the paper discharge section 21 are arranged. The fixing device 26 consists of a fixing roller 27 and a pressing roller 28 which is brought into press contact with the fixing roller 27 under, for example, a pressure of 40 kg.

Figure 2:
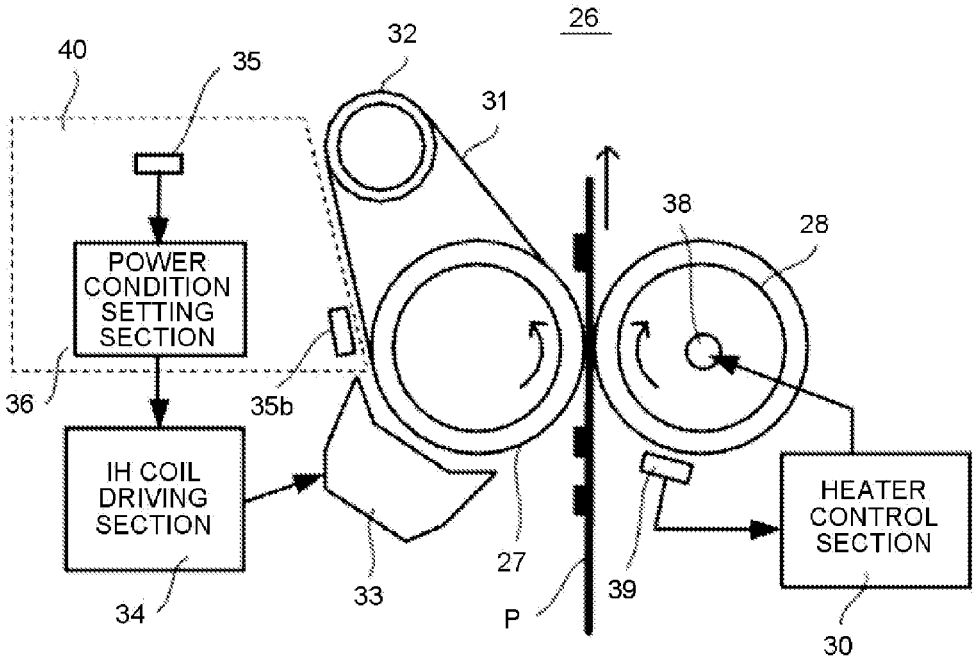
FIG. 2 is a block diagram illustrating an example of the constitution of a fixing device according to the first embodiment shown in FIG. 1.

The constitutions of the fixing device 26 are described with reference to FIG. 2. The fixing device 26 heats the fixing roller 27 and the fixing belt 31 through electromagnetic induction (IH) heating. The fixing device 26 comprises the fixing roller 27, the belt-shaped fixing belt 31 which is wound around the fixing roller 27 and heated, and a tension roller 32, around which the fixing belt 31 is wound, for applying tension to the belt 31. The running speed of the fixing belt 31 is the process speed of the fixing device 26.

The fixing device 26 further comprises an IH coil 33 which directly heats the fixing belt 31 from the outside through induction heating, an IH coil driving section 34 which supplies power for the IH coil 33, a machine temperature sensor 35 which detects the temperature in the machine and a power condition setting section 36 which carries out a control on the IH coil driving section 34 so as to detect the temperature outside the fixing belt 31 using a fixing belt temperature sensor 35*b* and to control the temperature of the fixing belt.

The fixing device 26 further includes the pressing roller 28 arranged opposite to the fixing roller 27, on which the fixing belt 31 is wound, to press against the recording paper P from the back side of the recording paper P; a heater 38 arranged inside the pressing roller 28; a pressing roller temperature sensor 39 which detects the temperature outside the pressing roller 28; and a heater control section 30 which controls the power supplied for the heater 38 according to the temperature detected by the temperature sensor 39.

Figure 3:
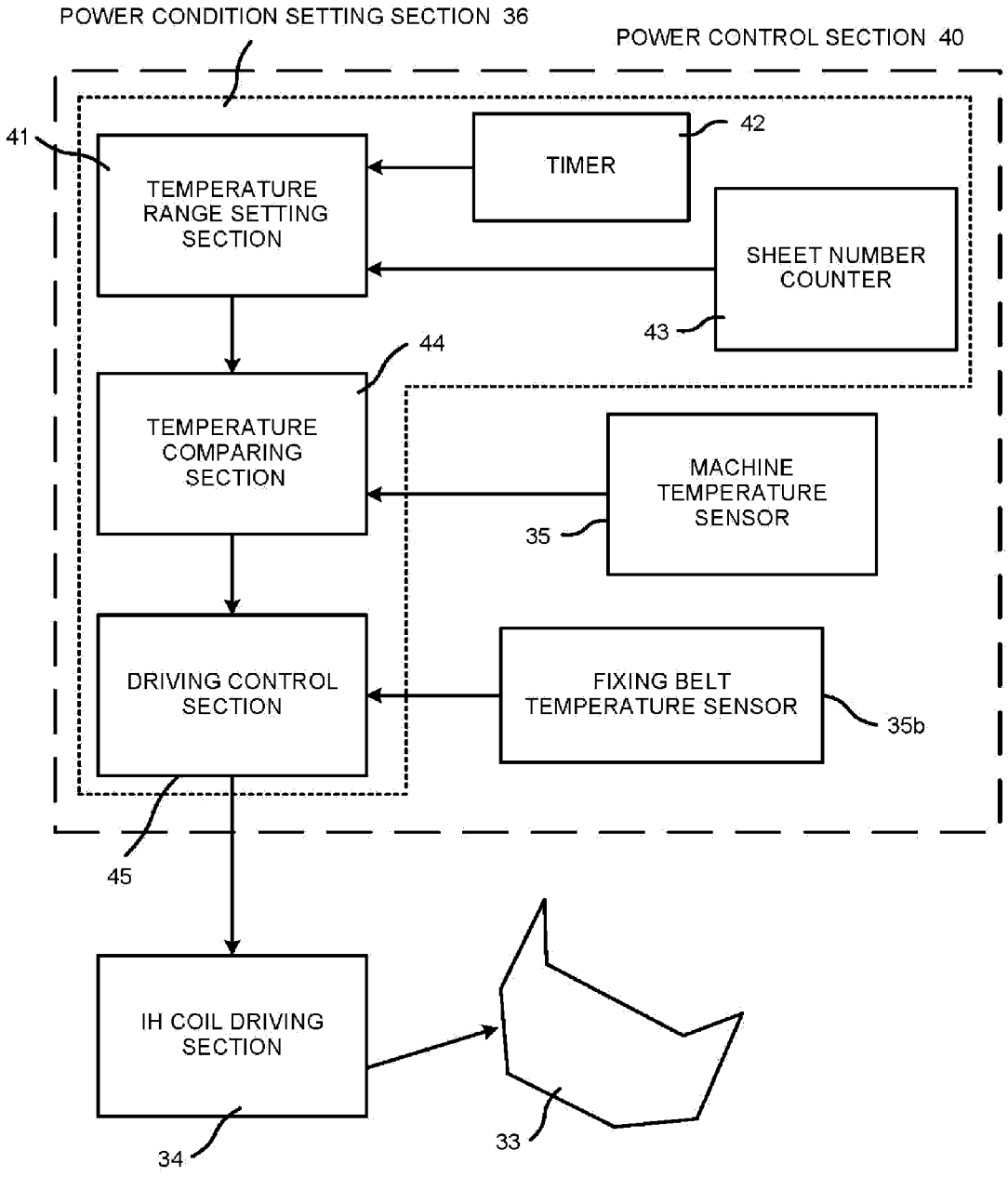
FIG. 3 is a diagram illustrating an example of the constitution of a power condition setting section according to the first embodiment.

The relation among the IH coil 33, the IH coil driving section 34, the machine temperature sensor 35, the fixing belt temperature sensor 35*b* and the power condition setting section 36 is shown in FIG. 3.

The machine temperature sensor 35, the fixing belt temperature sensor 35*b* and the power condition setting section 36 constitute a power control section 40. The power condition setting section 36 comprises a temperature range setting section 41 for setting a given temperature range, a timer 42 and a sheet number counter 43 which are connected with the temperature range setting section 41, a temperature comparing section 44 for comparing the temperature set by the temperature range setting section 41 with the temperature detected by the machine temperature sensor 35, and a driving control section 45 which carries out a control according to the output of the temperature comparing section 44. The driving control section 45 drives and controls the IH coil driving section 34.

The IH coil driving section 34 and the IH coil constitute an induction heating section. The paper-passing time is measured by the timer 42 from the start of the operation of the induction heating section, and a control is carried out to narrow an allowable temperature range in response to the paper-passing time. Further, as will be described later, the number of paper passing through the fixing device is measured by the sheet number counter 43, and a control is carried out to narrow the allowable temperature range in response to the number of passing paper.

Figure 4:
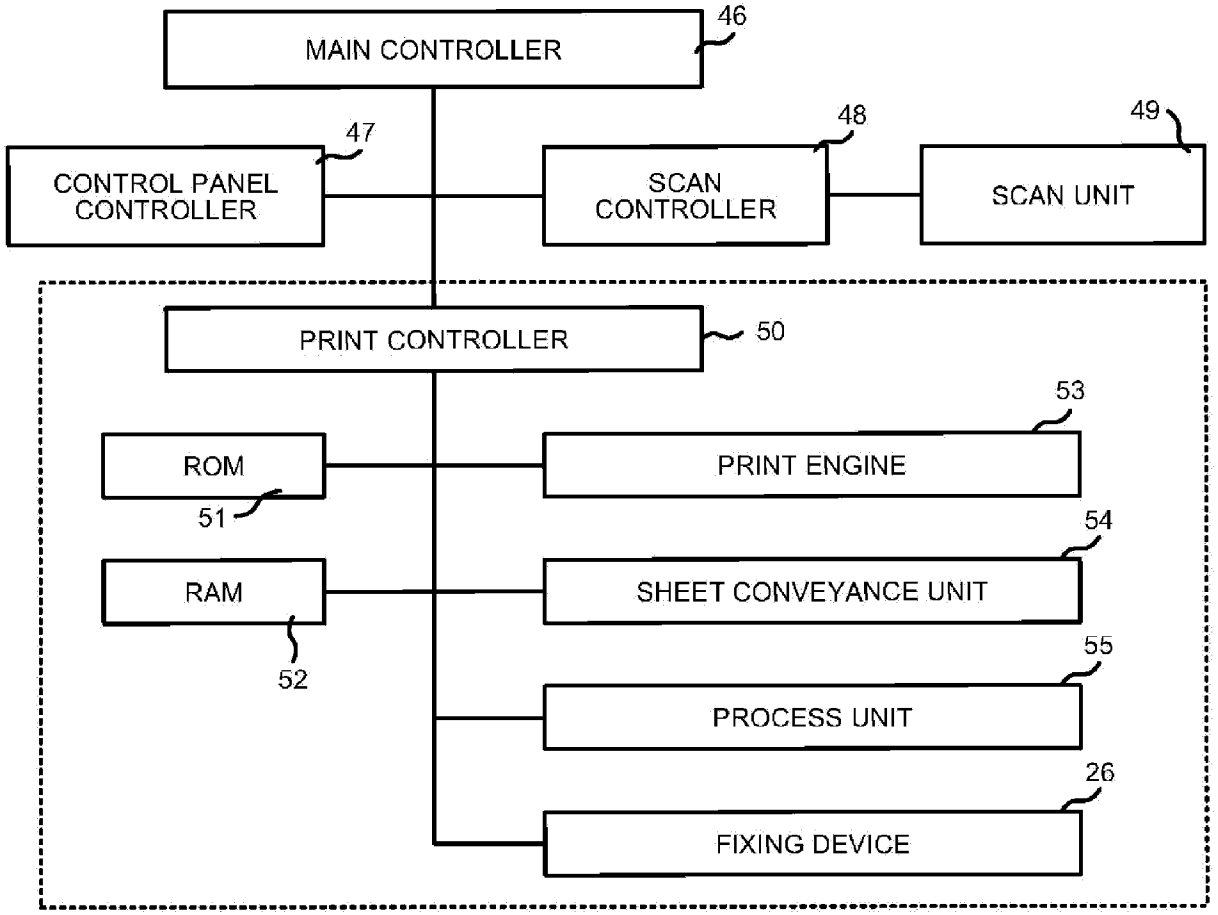
FIG. 4 is a block diagram illustrating a control system of the image forming apparatus.

FIG. 4 is a block diagram illustrating a control system of the image forming apparatus. A control panel controller and a scan controller 48 are connected with a main controller 46, and the scan controller 48 is connected with a scan unit 49. Further, a print controller 50 is connected with the main controller 46. The main controller 46 uniformly controls the control panel controller 47, the scan controller 48 and the print controller 50. The scan controller 48 controls the scan unit 49 which optically reads an image on a document.

A ROM 51 for storing a control program, a RAM 52 for storing data, a print engine 53, a paper conveyance unit 54, a process unit 55 and the fixing device 26 are connected with the print controller 50, respectively. The print engine 53 emits laser light to form the image read by the scan unit 49 on the photoconductive drum of the process unit 55. The paper conveyance unit 54 consists of a conveyance mechanism of the paper P and a drive circuit thereof, and the like.

The process unit 55 forms an electrostatic latent image corresponding to the image read by the scan unit 49 on the surface of the photoconductive drum through the laser light emitted from the print engine 53, develops and visualizes the electrostatic latent image on the photoconductive drum with developing agent (toner), and transfers the toner image to the paper P.

Herein, the relation between the temperature measured by the fixing belt temperature sensor 35*b* and the amount of power supplied for the IH coil 33 by the IH coil driving section 34 is described with reference to FIG. 5 (A) and FIG. 5 (B). The temperature of the fixing belt, which is detected by the fixing belt temperature sensor 35*b*, changes according to the amount of power supplied for the IH coil 33.

A standard setting temperature (lower limit setting temperature) $T_0$ is, for example, 170 degrees centigrade. As shown in FIG. 5 (A), with respect to the standard setting temperature $T_0$, the upper limit setting temperature of the fixing belt is changed from $T_2$ to $T_1$, and then from $T_1$ to $T_0$ as the paper-passing time increases. Thus, the allowable temperature range ($T_2$~$T_1$, $T_1$~$T_0$ and the like) for the paper-passing time becomes narrow as the paper-passing time increases. Further, the allowable temperature range becomes zero and then minus ($T_{-1}$~$T_0$) as the paper-passing time increases.

Figure 5:
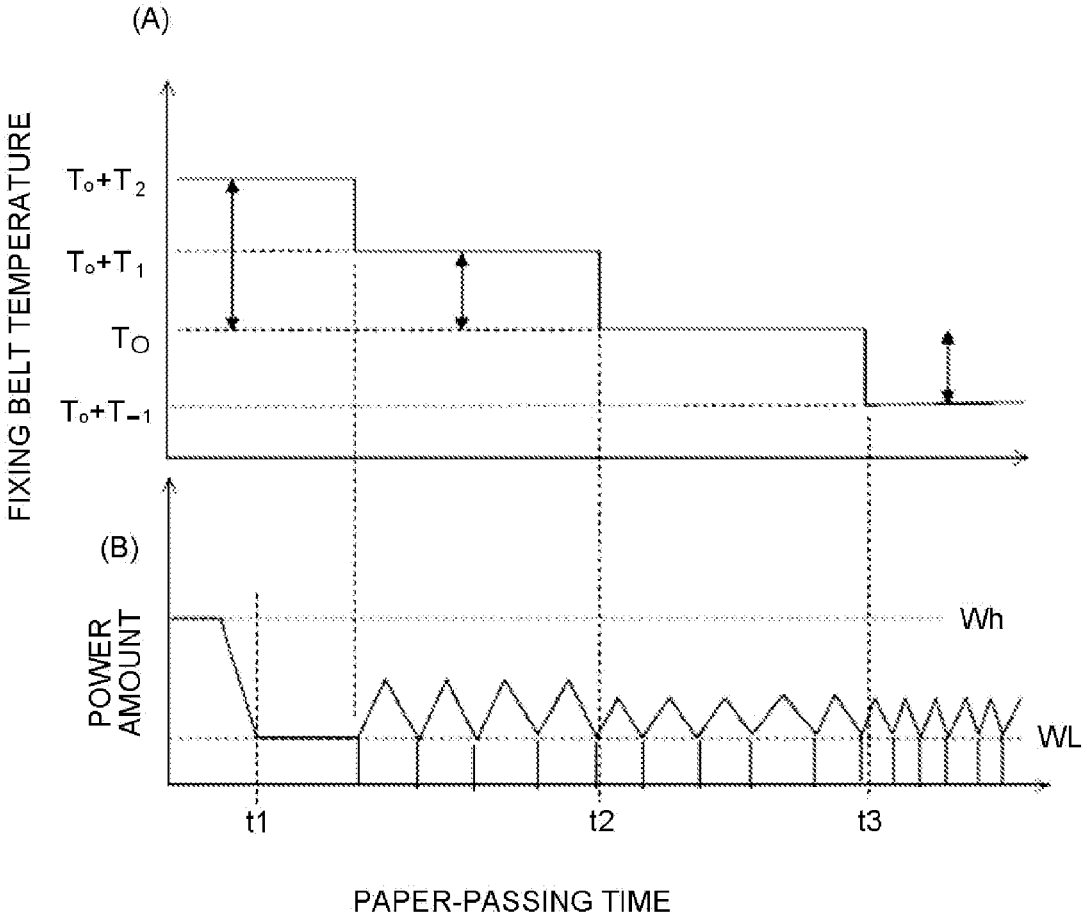
FIG. 5 is a diagram illustrating the relation among a paper-passing time, a fixing belt temperature and a power amount for controlling the temperature.

At this time, the amount of power supplied for the IH coil 33 by the IH coil driving section 34 is as shown in FIG. 5 (B). The amount of supplied power changes among a maximum power amount (upper limit) $W_h$, a minimum power amount (lower limit) $W_L$ and 0.

In a case of desiring to set the temperature of the fixing belt 31 in a range of (T2~T0) first, the maximum power amount (upper limit) $W_h$ is supplied so as to raise the temperature of the IH coil, that is, the temperature of the fixing belt. At the time t1, if the temperature reaches the upper limit setting temperature T2, the power amount is reduced to the minimum power amount (lower limit) $W_L$ in stages. Next, if a given paper-passing time elapses, the allowable temperature range of the fixing belt is lowered to ($T_1$~$T_0$). At this time, the power amount is intermittently increased from the minimum power amount (lower limit) $W_L$, so as to maintain the fixing belt temperature at a constant value ($T_1$).

Next, when lowering the allowable temperature range of the fixing belt to zero, that is, to the standard setting temperature $T_0$, the power amount is intermittently increased from the minimum power amount $W_L$ in a more frequent manner, so as to maintain the fixing belt temperature at a constant value ($T_0$). When lowering the temperature range of the fixing belt to $T_0$~$T_{-1}$, similarly, the power amount is intermittently increased from the minimum power amount $W_L$ in a more frequent manner. In this case, the allowable temperature range is minus.

The control of the allowable temperature range in the temperature range setting section 41 in the present embodiment is described below.

First, the temperature (Te) in the machine is detected by the machine temperature sensor 35 shown in FIG. 3. According to the detected temperature, for example, the temperature range is divided into three parts, that is, a low temperature when the machine temperature is below 16 degrees centigrade, an ordinary temperature when the machine temperature is above 16 degrees centigrade but below 30 degrees centigrade, and a high temperature when the machine temperature is above 30 degrees centigrade. Then, according to the number of sheets on which printing is carried out by the image forming apparatus, power is supplied for the IH coil 33 by the IH coil driving section 34 and the driving control section 45 and the temperature of the fixing belt 31 is controlled. In addition, the temperature of the fixing belt 31 is detected by the fixing belt temperature sensor 35*b*.

Figure 6:
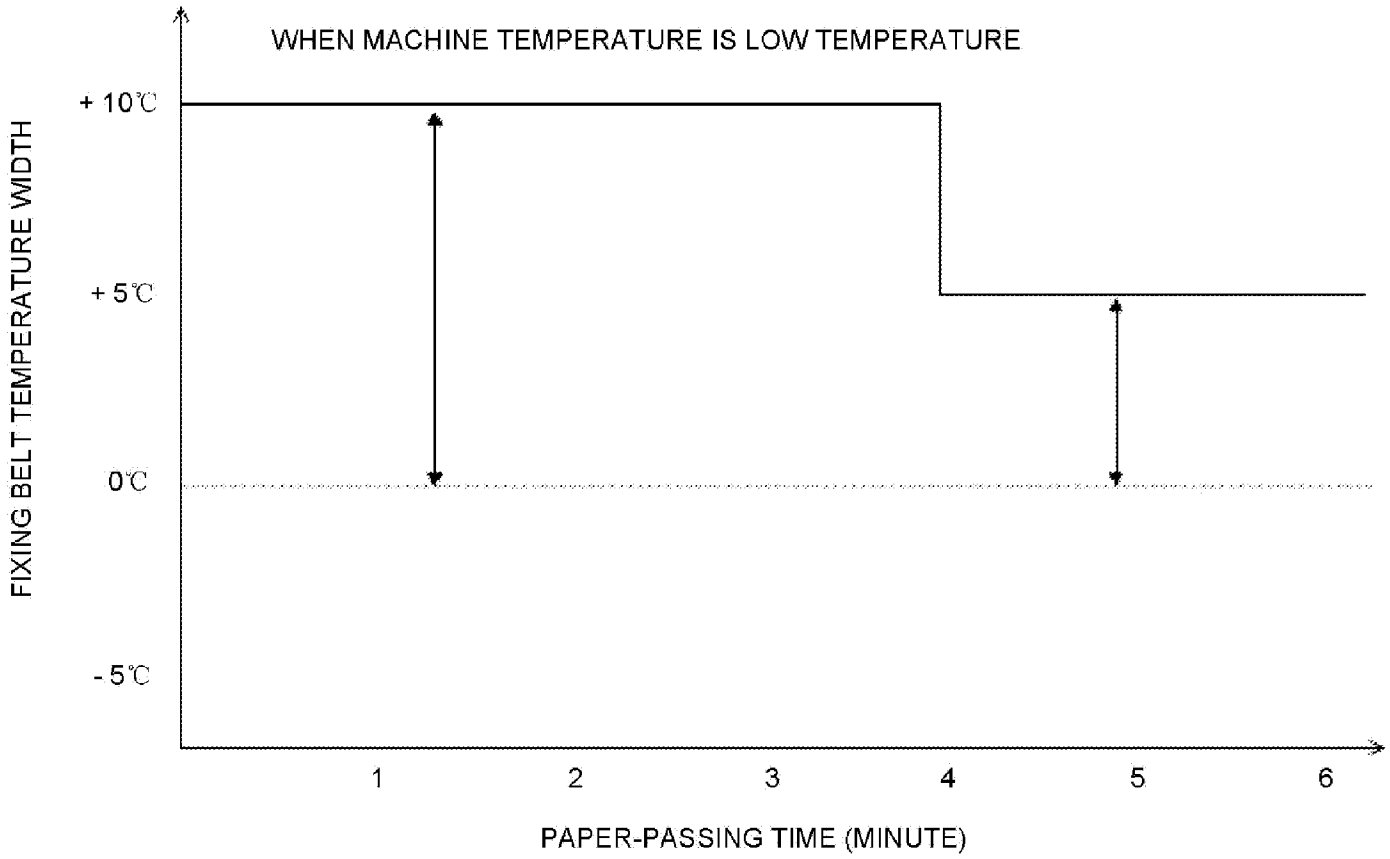
FIG. 6 is a diagram illustrating the relation between the paper-passing time and the fixing belt temperature when the machine temperature is low temperature.
Figure 7:
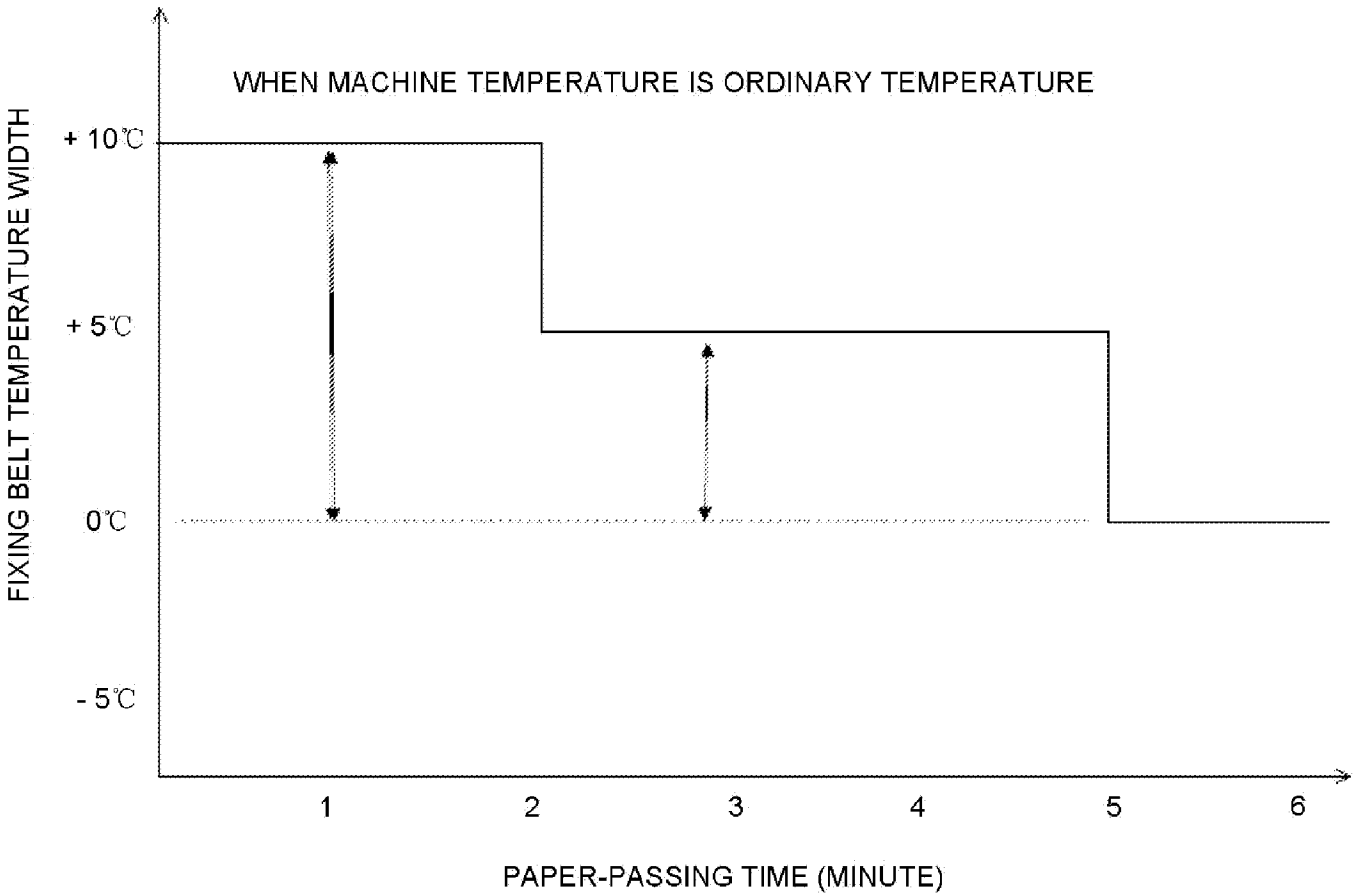
FIG. 7 is a diagram illustrating the relation between the paper-passing time and the fixing belt temperature when the machine temperature is ordinary temperature.
Figure 8:
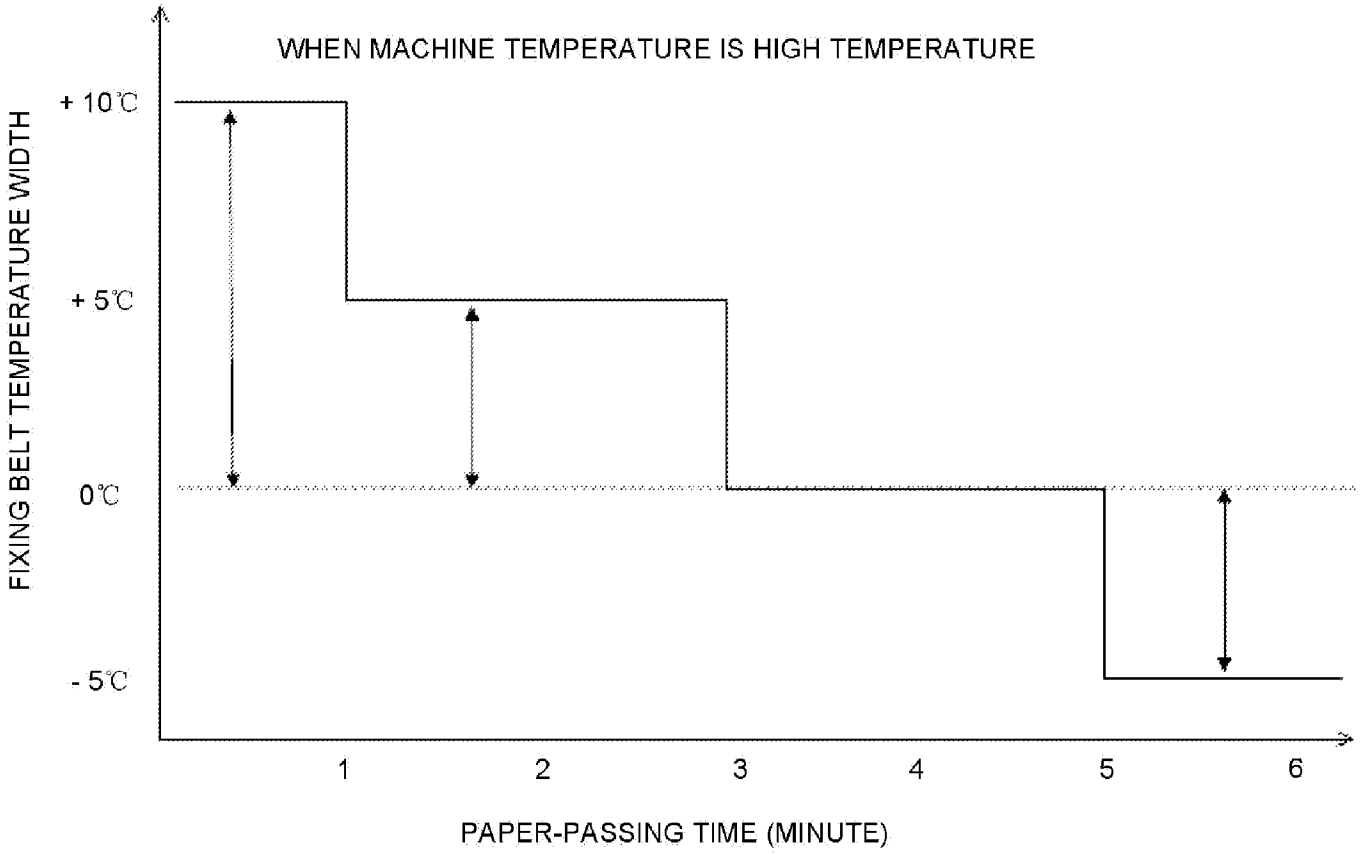
FIG. 8 is a diagram illustrating the relation between the paper-passing time and the fixing belt temperature when the machine temperature is high temperature.

FIG. 6, FIG. 7 and FIG. 8 respectively illustrate the surface temperature (allowable temperature width) of the fixing belt 31 when the machine temperature is low temperature, ordinary temperature and high temperature. In FIG. 6, FIG. 7 and FIG. 8, the abscissa represents the number of recording paper passing through the fixing device 26, that is, paper-passing time (minute), and the ordinate represents the fixing belt temperature (allowable temperature width) (° C.) For example, the standard setting temperature Tc is set to 170 degrees centigrade.

The temperature of the fixing belt 31 is measured by the fixing belt temperature sensor 35*b*. For example, as shown in FIG. 6, when the machine temperature is low temperature, the upper limit setting temperature is set to +10 degrees centigrade and the allowable temperature range is set to +10~0 degrees centigrade, that is, 180~170 degrees centigrade when the paper-passing time is less than four minutes. When the paper-passing time exceeds 4 minutes, the upper limit setting temperature is set to +5 degrees centigrade and the allowable temperature range is set to +5~0 degrees centigrade, that is, 175~470 degrees centigrade.

Further, when the machine temperature Te is ordinary temperature, as shown in FIG. 7, the upper limit setting temperature of the fixing belt is set to +10 degrees centigrade and the allowable temperature range is set to +10~0 degrees centigrade, that is, 180~170 degrees centigrade when the paper-passing time is less than two minutes.

When the paper-passing time exceeds two minutes, the upper limit setting temperature of the fixing belt is lowered to +5 degrees centigrade and the allowable temperature range is set to +5~0 degrees centigrade, that is, 175~170 degrees centigrade. Further, when the paper-passing time exceeds five minutes, the upper limit setting temperature of the fixing belt temperature is lowered to 0 degree centigrade. At this time, the allowable temperature range becomes zero.

Moreover, when the machine temperature Te is high temperature, the allowable temperature range is controlled as shown in FIG. 8. When the paper-passing time is less than one minute, the upper limit setting temperature of the fixing belt is set to +10 degrees centigrade, and when the paper-passing time exceeds one minute, the upper limit setting temperature of the fixing belt is lowered to +5 degrees centigrade, further, when the paper-passing time exceeds three minutes, the upper limit setting temperature of the fixing belt is lowered to 0 degree centigrade. Then, when the paper-passing time exceeds five minutes, the lower limit setting temperature of the fixing belt is lowered to −5 degrees centigrade. At this time, the allowable temperature range is set to 0~−5 degrees centigrade, that is, 170~165 degrees centigrade.

Such a relation of controlling the temperature of the fixing belt based on the machine temperature and the paper-passing time is shown in FIG. 8. In addition, in FIG. 8, $T_2$=+10 degrees centigrade, $T_1$=+5 degrees centigrade, $T_0$=0 degree centigrade, and $T_{-1}$=−5 degrees centigrade. In FIG. 8, when the machine temperature is low temperature, ordinary temperature and high temperature, the upper limit setting temperature is lowered according to the paper-passing time from the start of the printing. The lower limit setting temperature is $T_0$. However, in a case of $T_{-1}$, in fact, the upper limit setting temperature $T_{-1}$ is lower than the lower limit setting temperature $T_0$, in this case, the allowable temperature range becomes minus.

The relation of the fixing belt temperature according to the paper-passing time and the machine temperature is shown in FIG. 9.

By the way, it is also possible to lower the temperature of the IH coil according to the number of paper passing through the fixing device 26, that is, the number of passing paper, instead of the paper-passing time. Examples of the numbers of passing paper are shown in the rightmost column of the table shown in FIG. 9. In this case, similar to the case of the example described above, the temperature of the IH coil is lowered in response to the increase of the number of passing paper, which is just the same as the case of the paper-passing time shown in FIG. 6, FIG. 7 and FIG. 8 which illustrate a case where the machine temperature is low temperature, ordinary temperature and high temperature, respectively.

In addition, it is also possible to carry out power supply in the following way. During the warming up (W/U) of the operation start of the image forming apparatus, for example, a control is carried out so that the amount of power supplied for the coil is sequentially stepped up by 200 W every 200 ms until the surface temperature of the fixing belt 31 reaches a target temperature. Such a control is executed by the IH coil driving section 34 according to an instruction from the driving control section 45 shown in FIG. 3. Under the control of the driving control section 45, the IH coil driving section 34 controls the supply of high frequency electric power to the IH coil 33. The temperature of the fixing belt 31 is controlled through the power supply from the IH coil driving section 34 in response to the upper limit temperature setting values, that is, +10 degrees centigrade, +5 degrees centigrade and 0 degree centigrade, and the lower limit temperature setting value, that is, −5 degrees centigrade.

Figure 10:
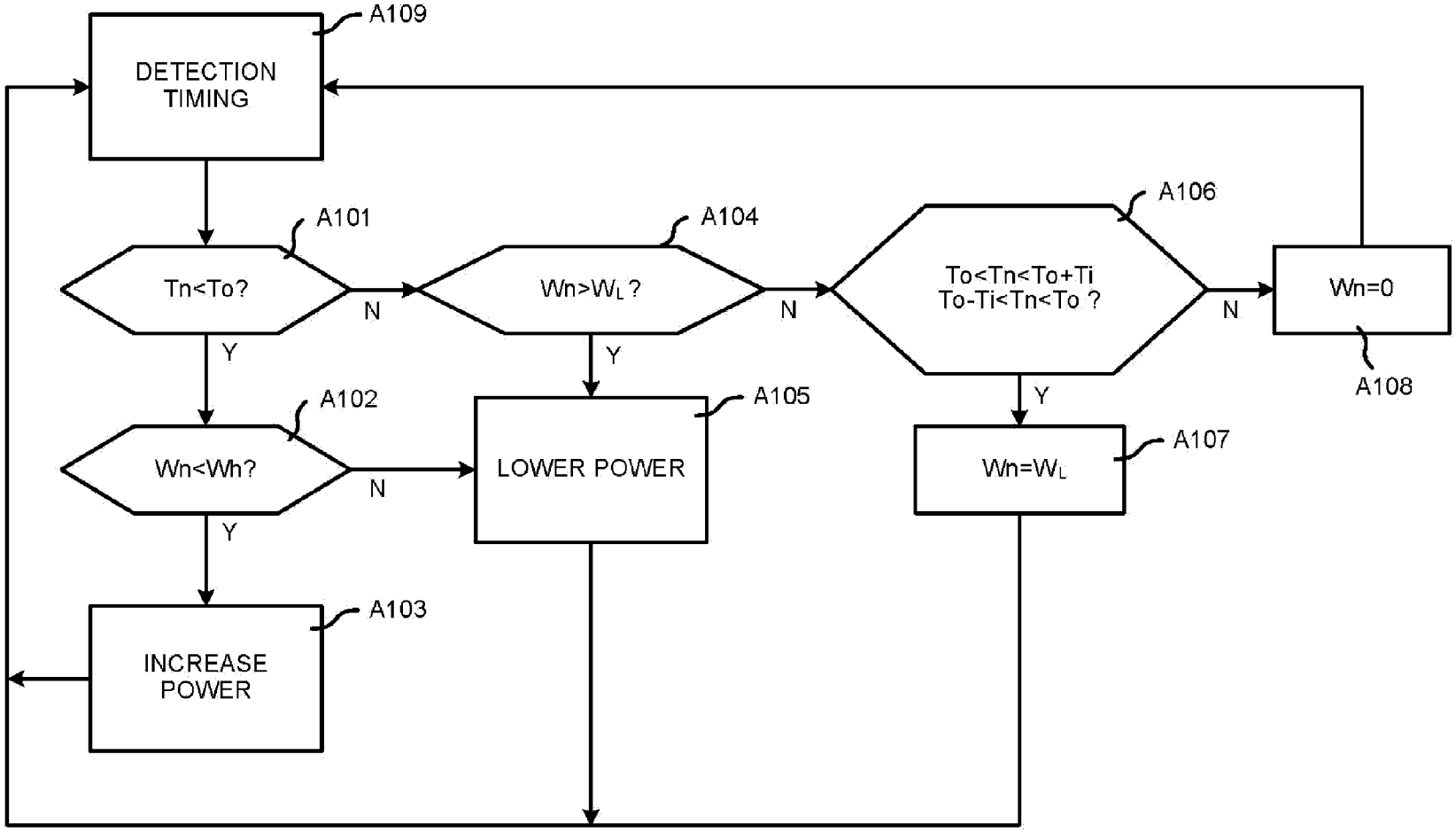
FIG. 10 is a flowchart illustrating the relation between the fixing belt temperature and the power amount control.

FIG. 10 is a flowchart illustrating fixing belt temperature and the increase and drop of power.

The temperature $T_0$ is the control temperature and the temperature Tn is the detected current fixing belt temperature. Wn is the current power value of the induction heating power, Wh is the maximum power amount (upper limit power setting value), and WL is the minimum power amount (lower limit power setting value). The fixing belt temperature changes in the range of $T_0$+Ti, $T_0$−Ti around the temperature Tc.

First, in ACT A101, it is determined whether the detected temperature Tn is lower or higher than the temperature $T_0$. In a case where the detected temperature Tn is lower than the temperature $T_0$, the flow proceeds to ACT A102, and if the current power value Wn is smaller than the upper limit power setting value, the power is increased in ACT A103.

On the other hand, in a case where the detected temperature Tn is higher than the temperature $T_0$ (NO in ACT A101), it is determined whether or not the current power value Wn is greater than the lower limit power setting value $W_L$ in ACT A104. In a case where the power value Wn is greater than the lower limit power setting value $W_L$, the power is lowered in ACT A105. Further, in a case where the power value Wn is smaller than the power value $W_L$ (NO in ACT A104), in ACT A106, it is determined whether or not the detected temperature Tn is higher than the temperature $T_0$ and lower than the temperature $T_0$+Ti, or whether or not the detected temperature Tn is higher than the temperature $T_0$−Ti and lower than the temperature $T_0$.

In a case where the temperature meets these conditions (YES in ACT A106), the power Wn is set to the lower limit power setting value $W_L$, and in a case where the temperature does not meet these conditions (NO in ACT A106), the power Wn is set to zero in ACT A108.

After the processing in ACT A103, A105 and A107 described above is carried out, the flow proceeds to ACT A109 to wait for next detection timing. The processing following ACT A109 is the same as described above, that is, it is determined whether or not the detected temperature Tn is lower than the temperature $T_0$ in ACT A101. In this way, the amount of power supplied for the IH coil 33 can be controlled so as to control the fixing belt temperature.

In accordance with the present embodiment, in a given time range from the start of the fixing processing, the allowable temperature range can be narrowed in response to the increase of paper-passing time or the number of passing paper, thereby carrying out a stable fixing processing.

A Second Embodiment

By the way, in the image forming apparatus according to the first embodiment, there is only one category of recording paper, that is, plain paper. However, it is preferred to correct the temperature of the IH coil in the fixing device in a case where there is a plurality of categories of recording paper.

Such a second embodiment is described below. The constitutions shown in FIG. 1, FIG. 2 and FIG. 4 in the first embodiment are also used in the image forming apparatus of the second embodiment. An example of the constitution of a power control section in the second embodiment is shown in FIG. 11.

Figure 11:
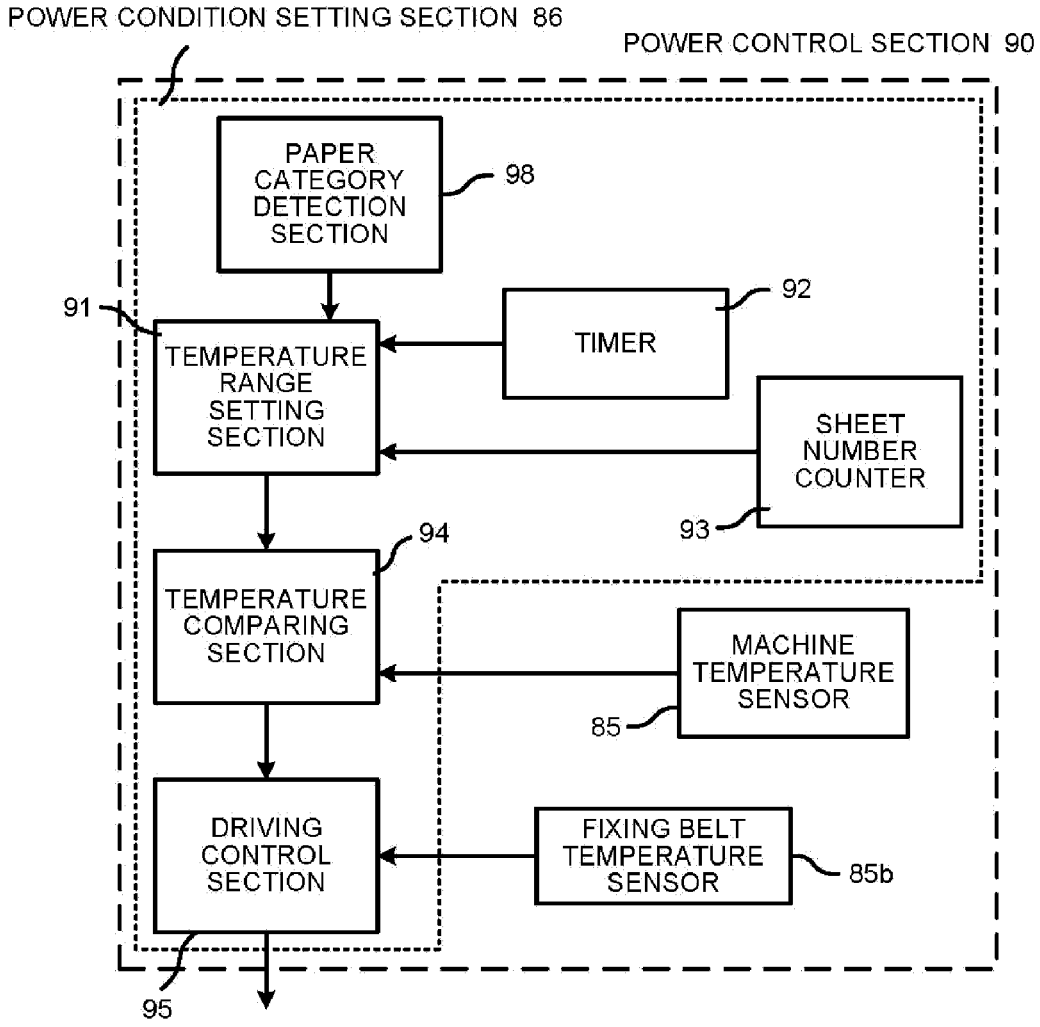
FIG. 11 is a diagram illustrating an example of the constitution of a power control section according to a second embodiment.

In FIG. 11, a machine temperature sensor 85, a fixing belt temperature sensor 85*b* and a power condition setting section 86 have the same functions corresponding to the machine temperature sensor 35, the fixing belt temperature sensor 35*b* and the power condition setting section 36 shown in FIG. 3 in the first embodiment.

Further, in FIG. 11, a power control section 90, a temperature range setting section 91, a timer 92, a sheet number counter 93, a temperature comparing section 94 and a driving control section 95 have the same functions corresponding to the power control section 40, the temperature range setting section 41, the timer 42, the sheet number counter 43, the temperature comparing section 44 and the driving control section 45 shown in FIG. 3 in the first embodiment. In the embodiment shown in FIG. 11, the power condition setting section 86 further comprises a paper category detection section 98 for determining the paper category according to the paper basis weight of the used recording paper, and the information of the determined paper category is input in the temperature range setting section 91.

In the present embodiment, the power condition setting section 86 comprises the temperature range setting section 91, the timer 92, the sheet number counter 93, the temperature comparing section 94, the driving control section 95 and the paper category detection section 98. The relation among the paper category, the paper basis weight and the correction condition of the upper limit setting temperature is shown in FIG. 12.

Basically, the temperature control shown in FIG. 9 is also carried out in the present embodiment. That is, in a case of plain paper having a paper basis weight of 80 g/m$^2$~105 g/m$^2$, and in a case of thick paper 2, thick paper 3 and thick paper 4 having a paper basis weight of more than 157 g/m$^2$, the temperature control shown in FIG. 9 is carried out.

Only in a case of plain paper having a paper basis weight of less than 79 g/m$^2$, recycled paper and thick paper 1 having a paper basis weight of 106 g/m$^2$~156 g/m$^2$, and when the machine temperature is ordinary temperature, is the control carried out according to the correction condition. A table of a correction condition 1 in a case of plain paper having a paper basis weight of less than 79 g/m$^2$ and recycled paper is shown in FIG. 13. Further, a table of a correction condition 2 in a case of thick paper 1 having a paper basis weight of 106 g/m$^2$~156 g/m$^2$ and when the machine temperature is ordinary temperature is shown in FIG. 14. In these cases, as shown in the rightmost column in FIG. 13 and FIG. 14, the upper limit temperature may be set using the number of passing paper instead of using the paper-passing time.

In accordance with the second embodiment, a proper fixing processing can be carried out according to the category of the recording paper.

In the embodiments described above, a case of fixing the toner image on the recording paper through the fixing belt is described. However, the present invention can also be applied to an image forming apparatus provided with a fixing device which fixes a toner image on a recording paper through a fixing roller, instead of a fixing belt.

In the embodiments described above, a case is described in which the machine temperature is divided into low temperature, ordinary temperature and high temperature by taking 16 and 30 degrees centigrade as a boundary to change the upper limit temperature setting value and the like. However, the present invention is not limited to this. The boundary when dividing the machine temperature is not limited to 16 and 30 degrees centigrade, and the machine temperature, which is not limited to be divided into three parts, may also be divided into two or more than four parts to change the upper limit temperature setting value and the like.

According to the embodiments described above, an image forming apparatus provided with a fixing device capable of carrying out a stable fixing processing is obtained.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a heating member configured to heat a recording medium, on the surface of which a toner image is carried, to fix the toner on the recording medium;

a pressing member configured to contact with the recording paper from the back side of the recording paper;

an induction heating section configured to heat the heating member through induction heating;

a temperature sensor configured to detect the temperature nearby the heating member;

a driving control section configured to maintain at least a standard setting temperature during a predetermined time from the start of a fixing processing and to carry out a control based on the temperature detected by the temperature sensor so that the temperature of the heating member based on the induction heating section is within an allowable temperature range; and a temperature range setting section configured to set the allowable temperature range so that the allowable temperature range is narrowed based on time elapsed from the start of the fixing processing.

2. The image forming apparatus according to claim 1, wherein the allowable temperature range is narrowed by lowering an upper limit setting temperature.

3. The image forming apparatus according to claim 2, further comprising:

a machine temperature sensor configured to detect the temperature in the machine of the image forming apparatus; wherein the allowable temperature range is set according to the machine temperature detected by the machine temperature sensor.

4. The image forming apparatus according to claim 3, wherein the temperature range setting section sets the given temperature range so that the given temperature range is narrowed according to a paper-passing time measured by a timer from the start of the operation of the induction heating section.

5. The image forming apparatus according to claim 3, wherein the temperature range setting section sets the given temperature range so that the given temperature range is narrowed according to the number (counted by a counter) of passing paper on which fixing processing is carried out from the start of the operation of the induction heating section.

6. An image forming apparatus, comprising:

a fixing roller configured to heat a recording paper, on the surface of which there is a toner image visualized with toner based on a latent image, from the surface having the toner image so as to fix the toner on the recording paper;

a pressing roller configured to contact with the recording paper from the back side of the recording paper;

a fixing belt configured to be wound on the fixing roller;

a tension roller, on which the fixing belt is wound, configured to apply tension to the fixing belt;

an induction heating section configured to heat the fixing belt through induction heating;

a temperature sensor configured to detect the temperature nearby the fixing belt;

a driving control section configured to maintain at least a standard setting temperature during a predetermined time from the start of a fixing processing and to carry out a control based on the temperature detected by the temperature sensor so that the temperature of the fixing belt based on the induction heating section is within an allowable temperature range including an upper limit setting temperature and a lower limit setting temperature; and a temperature range setting section configured to set the allowable temperature range so that the allowable temperature range is narrowed based on time elapsed from the start of the fixing processing.

7. The image forming apparatus according to claim 6, further comprising:

a paper category detection section configured to detect the category of the recording paper; wherein the temperature range is changed according to the paper category detected by the paper category detection section.

8. The image forming apparatus according to claim 7, further comprising:

a machine temperature sensor configured to detect the temperature in the machine of the image forming apparatus; wherein the allowable temperature range is set according to the machine temperature detected by the machine temperature sensor.

9. The image forming apparatus according to claim 8, wherein the temperature range setting section sets the given temperature range so that the given temperature range is narrowed according to a paper-passing time measured by a timer from the start of the operation of the induction heating section.

10. The image forming apparatus according to claim 8, wherein the temperature range setting section sets the given temperature range so that the given temperature range is narrowed according to the number (counted by a counter) of passing paper on which fixing processing is carried out from the start of the operation of the induction heating section.

* * * * *